US005588729A

United States Patent [19]

Berger

[11] Patent Number: 5,588,729

[45] Date of Patent: Dec. 31, 1996

[54] HARDWARE DEVICE FOR THE VERTICAL ADJUSTMENT OF DRAWERS

[75] Inventor: Horst Berger, Bielefeld, Germany

[73] Assignee: MEPLA-Werke Lautenschläger GmbH & Co. KG, Germany

[21] Appl. No.: 527,872

[22] Filed: Sep. 14, 1995

[30] Foreign Application Priority Data

Sep. 15, 1994 [DE] Germany ..... 44 32 820.6

[51] Int. Cl.[6] ..... A47B 88/00

[52] U.S. Cl. ..... 312/334.4; 312/330.1; 312/334.1; 312/334.5

[58] Field of Search ..... 312/334.4, 330.1, 312/334.1, 334.6, 334.7, 334.8, 334.9, 334.13, 334.14, 334.23, 334.24, 334.27, 348.1, 348.2

[56] References Cited

U.S. PATENT DOCUMENTS 4,653,821 3/1987 Faust ..... 312/330.1 X
4,810,045 3/1989 Lautenschläger ..... 312/334.5 X
5,310,255 5/1994 Ranallo ..... 312/334.1 X
5,375,922 12/1994 Brüstle et al. ..... 312/330.1 X
5,439,283 8/1995 Schröder et al. ..... 312/334.5 X

FOREIGN PATENT DOCUMENTS 4114708 11/1992 Germany ..... 312/334.1

*Primary Examiner*—Peter M. Cuomo
*Assistant Examiner*—Rodney B. White

[57] ABSTRACT

Hardware device for the vertically adjustable mounting of drawers extractably held in the carcase of furniture pieces by means of drawer slides. Each of the drawer slides has a guide rail for fastening in the carcase interior and a runner rail for attachment to the drawer on which races are provided for roller bodies or at least a roller journaled on one of the rails. In the vicinity of the carcase-front end of the drawer slide there is mounted a sector-shaped, thin adjuster for rotation about a vertical axis, the thickness of which measured in the vertical direction increases wedge-like in the direction of rotation from a radially disposed edge. The axis of rotation of the adjuster is so disposed with respect to the drawer slide that the portion that thickens wedge-like can be set between one of the rails of the drawer guide and a vertically opposite steady surface of the furniture piece.

8 Claims, 5 Drawing Sheets

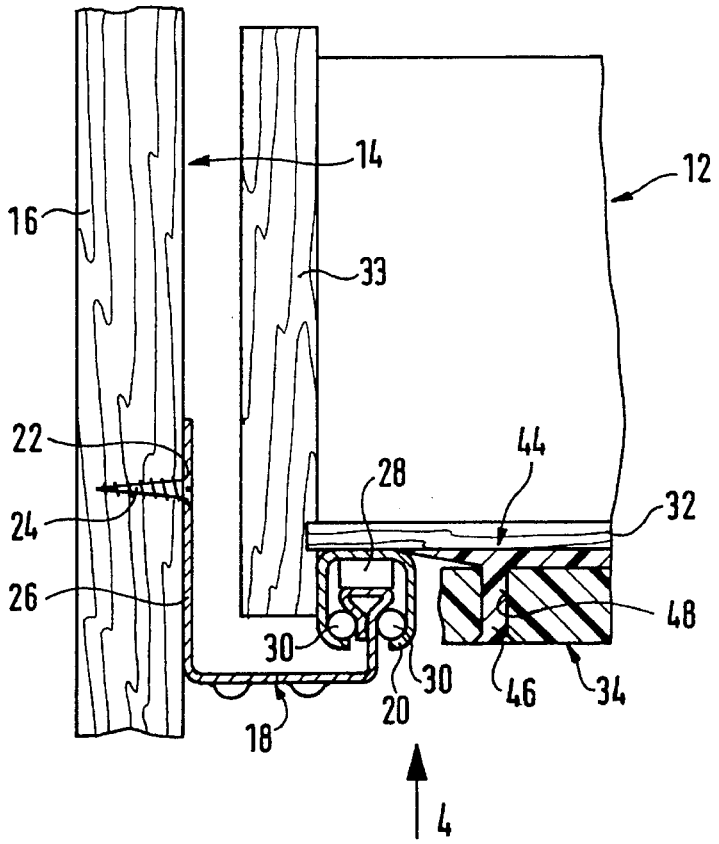
FIG. 2
FIG. 3a
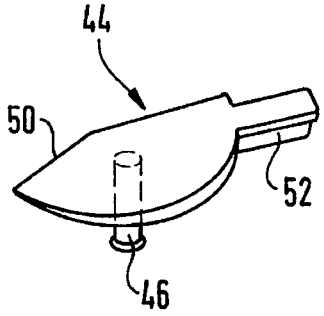
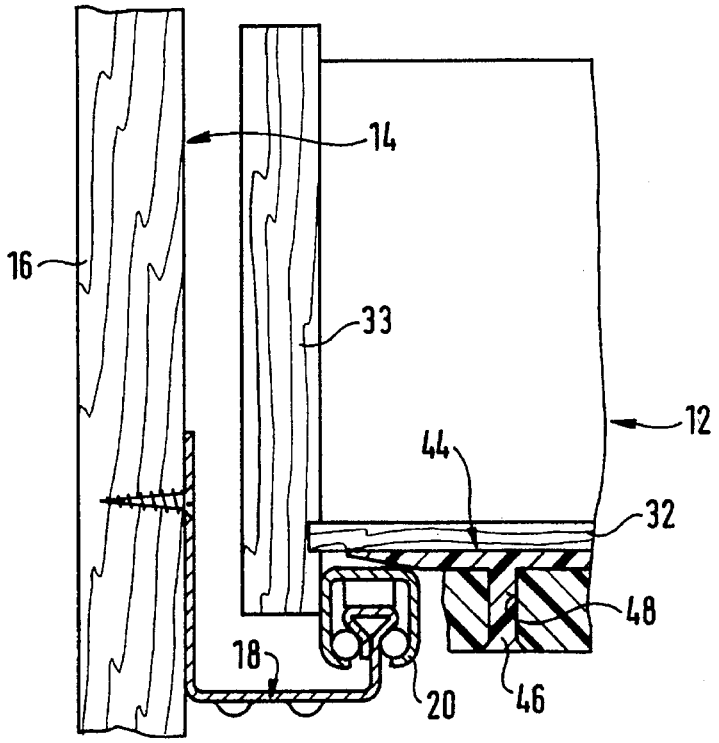
FIG. 3

HARDWARE DEVICE FOR THE VERTICAL ADJUSTMENT OF DRAWERS

BACKGROUND OF THE INVENTION

The invention relates to a hardware device for the vertically adjustable mounting of drawers mounted on drawer slides in the carcase of furniture, the drawer slides having each a guide rail fastened in the carcase interior and a runner rail provided on the drawer, on which races for rolling bodies are provided, or at least one roller rotatably mounted on one of the rails.

Such drawer slides, whose runner rail supports the drawer at its bottom directly next to the drawer side where the latter projects below the drawer bottom, are known in a form, for example, in which the guide rail fastened to the carcase wall is engaged from underneath in the corresponding runner rail fastened removably to the drawer and formed by a hollow profile that is open at the bottom; races for roller bodies held in an elongated cage are provided inside of the runner rail and can roll on races in the guide rail on the one hand and in races formed by associated parts of the inner surface of the runner rail. Due to their transverse stability when the drawer is in the open state, and the possibility of arranging the runner rail so as to be invisible under the drawer bottom when the drawer is open, such drawer slides have become increasingly popular in recent years. At its end within the carcase the runner rail is fastened by means of a hook projecting upward from the runner rail behind the drawer back and inserted in to a substantially horizontal bore in the drawer back, while mounting at the front end is accomplished, for example, by means of a pin projecting from the upper side of a bracket reaching underneath the drawer side and projecting into a bore in the front part of the edge of the associated drawer side (DE-OS 36 41 325). Since the pin is inserted only from underneath into the associated bore in the drawer side, the drawer can be removed relatively easily from the runner rail, by lifting it by the front in the open state of the drawer to such an extent that the pin comes free of the bore, whereupon the drawer as a whole is removed forwardly, i.e., in the drawer-opening direction, from the hook inserted into the drawer back. Alternatively, the mounting of the front end of the runner rail can be performed also in or on a fitting fastened to the drawer bottom or to the inner side of the drawer front reaching down below the bottom, the fitting having a spring that is flexible transversely of the drawer opening direction and having at its free, flexible end a projection which can be snapped into a matching bore in the associated surface of a limb of the runner rail. In such a case, the mounting of the drawer is performed simply by placing it on the two runner rails and inserting the drawer horizontally. Then the open end of the hook provided on the rearward end of the runner rail inserts itself into the bore in the drawer back and the front end of the runner rail passes between the flexible spring and the drawer side downwardly overlapping the drawer bottom. The spring is thus flexed away from the drawer side and then, as the projection provided on its free end comes into alignment with the opening in the runner rail, it snaps into the opening and thus connects the runner rail to the mounting device.

To permit the drawer to be adjusted vertically thereafter, in accord with a proposal not previously published (German Patent application P 44 14 462.8), a pushing means provided with a placement surface facing the drawer bottom as disposed for displacement over a given adjusting distance parallel to the runner rail but inclined at an angle with respect to the drawer-opening direction, so that the placement surface which in the starting position is flush with the underside of the drawer bottom undergoes a change in level due to longitudinal displacement and lifts the drawer bottom, and with it the drawer. Inasmuch as the drawer is held at its front end by the pin engaged in the bore in the face of the drawer side, the pin is drawn out of the bore by an amount corresponding to the vertical adjustment.

SUMMARY OF THE INVENTION

The invention is addressed to the problem of designing a hardware device for the vertical adjustment of drawers of simplified construction and reliable operation, which can be integrated into mounting hardware provided for the front end of one of the rails of a drawer slide.

According to the invention, this problem is solved by the fact that, in the vicinity of the front end of the drawer slide, a substantially sector-shaped flat adjuster is mounted for rotation about a vertical axis; its thickness measured vertically increases wedge-like in the direction of rotation from an approximately radially disposed edge, and the pivot axis of the adjuster with respect to the drawer slide is so disposed that the gradually thickening portion can be placed between one of the rails of the drawer slide and a steady surface vertically opposite the latter on the cabinet. By rotating the adjuster, therefore, the thickening area of the adjuster running circumferentially penetrates into the space between the rail and the cabinet surface on which it rests, thereby positively varying the distance between the rail and the latter surface.

To make the rotation of the adjuster easy and effortless, it is expedient to provide a lever arm running radially to the axis of rotation to be provided as a handle on the circumference of the adjuster.

The adjuster can be mounted on the underside of the drawer bottom for rotation about a vertical axis in the vicinity of the drawer-front end of the runner rail mounted on the drawer, in which case the axis of rotation of the adjuster is disposed with respect to the front end of the runner rail such that the substantially radially disposed edge of the adjuster lies directly beside the runner rail in the initial position, and runs in the longitudinal direction of the runner rail, and when the vertical adjustment is made by turning the sector-shaped adjuster it is thrust between the runner rail and the underside of the drawer bottom. The vertical adjustment of the drawer is thus performed by raising the front end of the drawer from the runner rail that carries it.

If the drawer-front end is joined to the drawer by a mounting piece disposed on the drawer, it is recommendable to mount the sector-shaped adjuster for rotation in this mounting piece, i.e., to combine the piece for mounting the front end of the runner rail with the hardware for the vertical adjustment.

If the hardware for mounting the drawer-front end of the runner rail has a leaf spring which flexes toward the inside surface of the drawer side overlapping the bottom and has a latch projection which fits into a recess in the runner rail between the spring and the inside surface of the drawer side, the axis of rotation of the sector-shaped adjuster is expediently provided in the vicinity of the leaf spring of the mounting hardware for the runner rail such that when in the initial position the radially disposed edge of the adjuster will be between the drawer bottom and the part of the spring provided with the latch projection. When a vertical adjustment is made, then not only will the runner rail be pushed away from the drawer bottom, but at the same time the spring will be flexed in the same direction and to the same extent in the vertical direction, so that there is no danger that the latch projection provided on the spring will snap out of the associated recess in the runner rail.

In cabinets in which the drawers are held extractably and on whose open front vertical frame elements projecting from the cabinet side walls narrow the free cabinet opening are provided, between which horizontal frame elements are disposed parallel to and at a distance from one another, which define rectangularly defined passage openings in the front of the carcase, through which a drawer body can be introduced into the carcase interior, the guide rails of drawer slides are, as a rule, not fastened directly on the inner side of the side walls of the carcase, but at a distance from the side wall which corresponds to the dimension, measured in the horizontal direction, of the frame elements projecting from the side walls. For this purpose, spacer elements fastened on the side wall can be provided in the carcase interior, to which the carcase-interior end of the guide rail is fastened. In the front end area, it is a good idea to fasten guide rails of appropriate length directly or indirectly to the edge of the vertical frame element. In this case the adjuster of the hardware according to the invention can also be mounted in the area of the front end of the guide rail in the carcase interior such that its area thickened wedge-wise can be placed between the bottom of the guide rail and a steady surface disposed in a manner not vertically variable in the carcase interior. The vertical adjustment of the drawer therefore is performed in this case, not by raising the drawer from the runner rail bearing it, but by varying the level of the front end of the guide rail and thus of the drawer slide as a whole relative to the cabinet carcase.

In an advantageous further development of the invention, the adjuster can in that case be mounted on a separate supporting component that can be fastened to the inwardly facing surface of one of the frame elements.

The supporting component can advantageously be in the form of an angle bracket whose vertical limb is displaceable vertically on the free edge of the horizontal frame element projecting from the adjacent cabinet side wall and can be fastened at selectable levels, while on the upper side of the second limb the front end of the guide rail is mounted, the adjuster being then journaled on the bottom of the second limb of the bracket such that the edge defining the area thickening wedge-like in the direction of rotation is, in the initial position, at the level of the gap formed between the second limb of the bracket and the upwardly facing surface forming the steady surface of the associated horizontal frame element.

The journaling of the adjuster is in that case expediently on the underside of a bearing projection protruding from the second bracket limb into the carcase interior.

It is advantageous also if a slot running vertically is provided in the vertical limb of the bracket, through which the shaft of a screw can be driven into the vertical frame element. Securing a vertical setting reached by rotating the adjuster is then achieved by tightening the screw that was loosened in the adjusting operation.

The adjuster can be formed together with the arm serving as handle as an integral piece injection molded from plastic, or also as an integral pressure casting of metal.

BRIEF DESCRIPTION OF THE DRAWINGS

The invention is explained in the following description of an embodiment in conjunction with the drawing wherein:

FIG. 2 is an enlarged cross section taken transversely to the direction of movement of the drawer slide, in the area of the hardware device for the vertical adjustment of a drawer.

FIG. 3 is a cross section corresponding to FIG. 2 at a position in which the drawer is lifted from the rail by the hardware device.

FIG. 3*a* is a perspective view of the adjuster of the hardware device according to the invention.

DETAILED DESCRIPTION OF THE INVENTION

Figure 1:
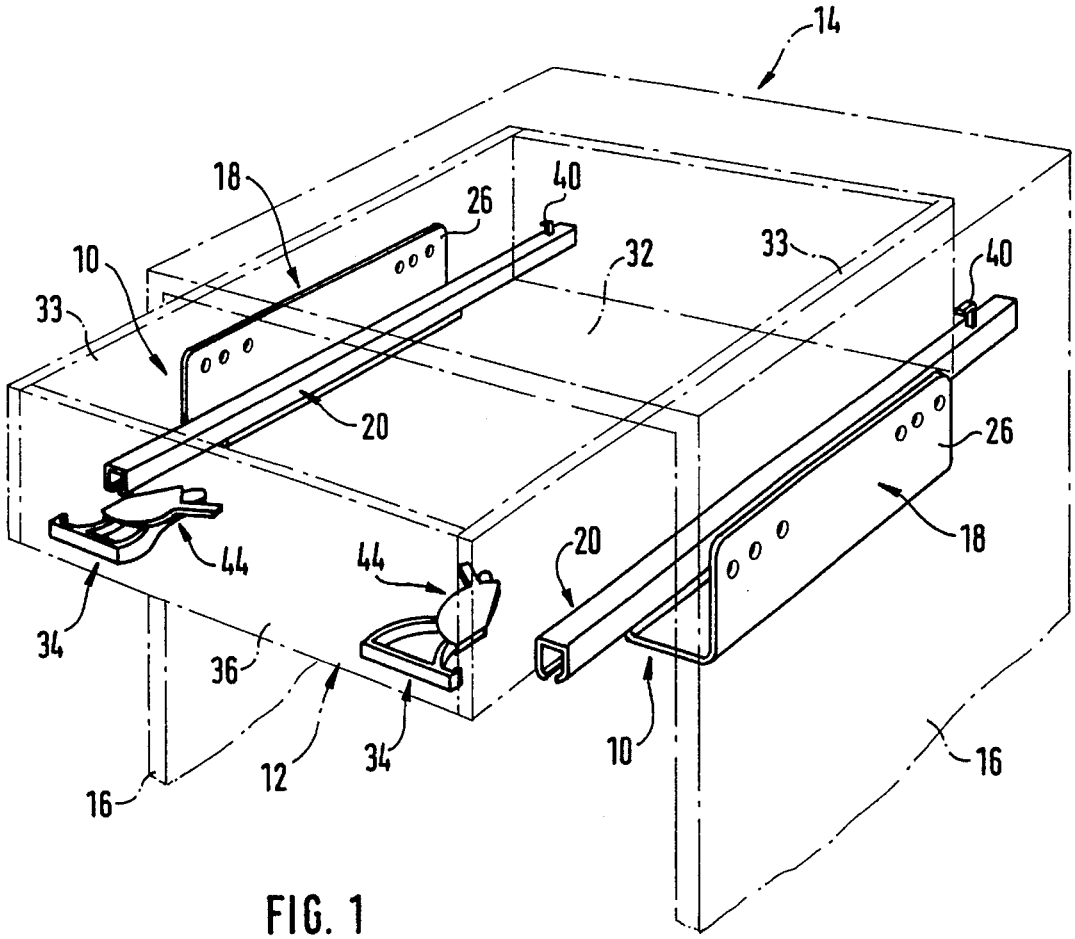
FIG. 1 is a perspective view of a pair of drawer slides for extractably mounting a drawer in a cabinet, having a hardware device combined with mounting hardware for the front end of the runner rail for the vertical adjustment of the drawer.

FIG. 1 is a perspective representation of a pair of drawer slides 10 which are designed for mounting a drawer 12, indicated in dash-dotted lines, in a cabinet carcase 14 likewise indicated in dash-dotted lines.

The drawer slides 10, of a basically known construction, which consist of the guide rails 18 fastened to the inside of the sides 16 of the cabinet and the runner rails supporting the drawer 12 on the bottom, are configured in the manner that can be seen especially in FIGS. 2 and 3. The guide rail 18 is, in the case represented, a profile of U-shaped cross section made from sheet metal, one limb of the U forming a plate 26, provided with bores 22 for mounting screws 24, which is to be screwed onto the inside of the side wall 16, while the second limb of the U is shaped at its free end such that it has within the runner rail 20, to be further described later on, tracks parallel with and at a distance from the plate 26, for rolling bodies in the form of cylindrical rollers 28 rolling on an upper race and two rows of balls 30 rolling on hollowed races spaced apart horizontally. The rollers 28 and balls 30 are held in their mutual association and alignment by a plastic cage of appropriate shape which is not shown.

The runner rail 20 is in turn configured as a hollow profile provided on its bottom with an opening to accommodate the limb of the U of guide rail 18 that is provided with the races, and it is shaped in cross section such that the rollers 28 and the balls 30 are snugly clutched, so that the inside surfaces of runner rail 20 serve also as races in the areas in contact with the rolling bodies.

Figure 4:
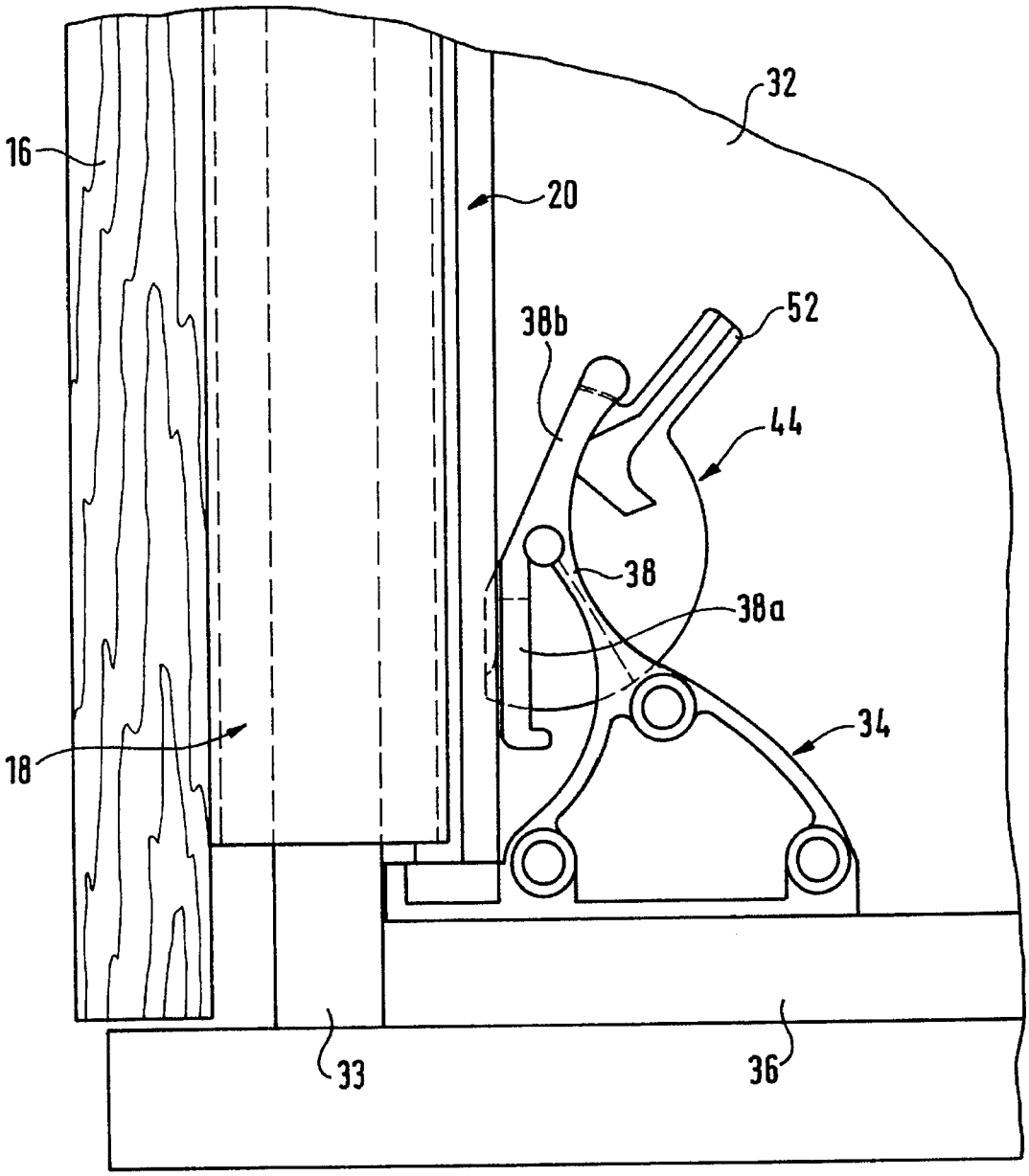
FIG. 4 is a view in elevation of a corner in the drawer front area of a drawer mounted for vertical adjustment in the manner of the invention, as seen in the direction of arrow 4 in FIG. 2.

The runner rail 20 is fastened to the drawer 12 in the position seen in FIGS. 2 and 3 beneath the bottom 32 of the drawer and along the inner surface of the drawer sides 33 reaching downward past the drawer bottom. A mounting device 34 (FIGS. 1 and 4) is provided on each side for mounting in the front area and is fastened in an appropriate manner to the drawer bottom 32 and/or the front 36 of the drawer 12. This device 34, known in itself and made of resiliently flexible plastic, has a leaf spring 38 which has a limb section 38*a* running in the drawer-opening direction, parallel and at a distance from the drawer side, from which a latch projection (not shown) projects from the side facing the runner rail and engages in a cut-out (also not shown) in the runner rail 20 as soon as the runner rail is in the intended mounting position under the drawer. At the rear end, i.e., the end inside the carcase, the runner rail extends slightly past the drawer back, and there it has a fastening hook 40 (FIG. 1) which consists of a section extending at first vertically upward from the upper, horizontal wall of the runner rail, and a horizontal section on the free end of this section, bent at right angles forward, i.e., out of the carcase interior, which can become engaged in an associated bore in the drawer back.

For the release of the drawer from the runner rail, there is a lever arm 38*b* (FIG. 4) on the leaf spring 38, which can be pressed toward the runner rail, thereby causing the above-mentioned latch projection to come out of the associated opening in the runner rail. The drawer can then simply be drawn forward from the runner rail, while the fastening hooks 40 are withdrawn from the associated bores in the drawer back.

For the vertical adjustment of the drawer 12, a flat adjuster 44 of an approximately sector-like shape in plan is provided at the upper side of the mounting device 34 facing the bottom 32 of the drawer with an integral pivot pin 46 which is rotatably mounted in a bearing bore 48 in the mounting device 34. The mounting of the pivot pin 46 in the bearing bore 48 is such that a radial edge 50 of the sector-shaped adjuster 44 is in the starting position, represented in FIGS. 2 and 4, between the limb section 38*a* of the leaf spring 38 of the mounting device 34 and the drawer bottom 32, directly parallel alongside the runner rail. The adjuster 44 is sharpened wedge-like in the area of this radial edge, and from the edge it increases in thickness in the circumferential direction. A radially projecting lever arm 52 serving as a handle is provided on the outer, circular-shaped circumference, preferably in a location approximately opposite the radial edge 50. When this lever arm 52 is rotated clockwise, with respect to its representation in FIG. 4, the wedge-like radial edge 50 is forced between the upper side of the runner rail 20 and the drawer bottom 32, and thus forcibly raises the drawer bottom, and thus the entire drawer 12, away from the upper side of the runner rail 20, thereby achieving the desired vertical adjustment of the drawer. At the same time the leaf spring 38, being of course flexible, is likewise deformed downwardly, so that there is no tendency for the latch projection to escape from the corresponding opening in the runner rail 20. When the adjuster 44 is turned back again, the drawer sinks downward of its own weight, onto the runner rail, this lowering, however, being additionally supported by the return force of the previously deformed leaf spring 38.

The adjuster 44 can be made of plastic together with the pivot pin 46 and the lever arm 52 as a one-piece injection molding, and alternatively its production from metal by the pressure casting method can be considered.

In the above-described embodiment, the adjuster 44 is mounted on a mounting device 34—which is available anyway—for the front end of the runner rail 20. If such a mounting device is not provided, and the drawer—for example—is held by the above-described pin engaged in a bore in the bottom of the face of the drawer side, the principle of the vertical adjustment by means of the adjuster 44 is still applicable. The pivot must then simply be provided in an appropriately configured bearing block to be provided separately on the drawer bottom.

Figure 5:
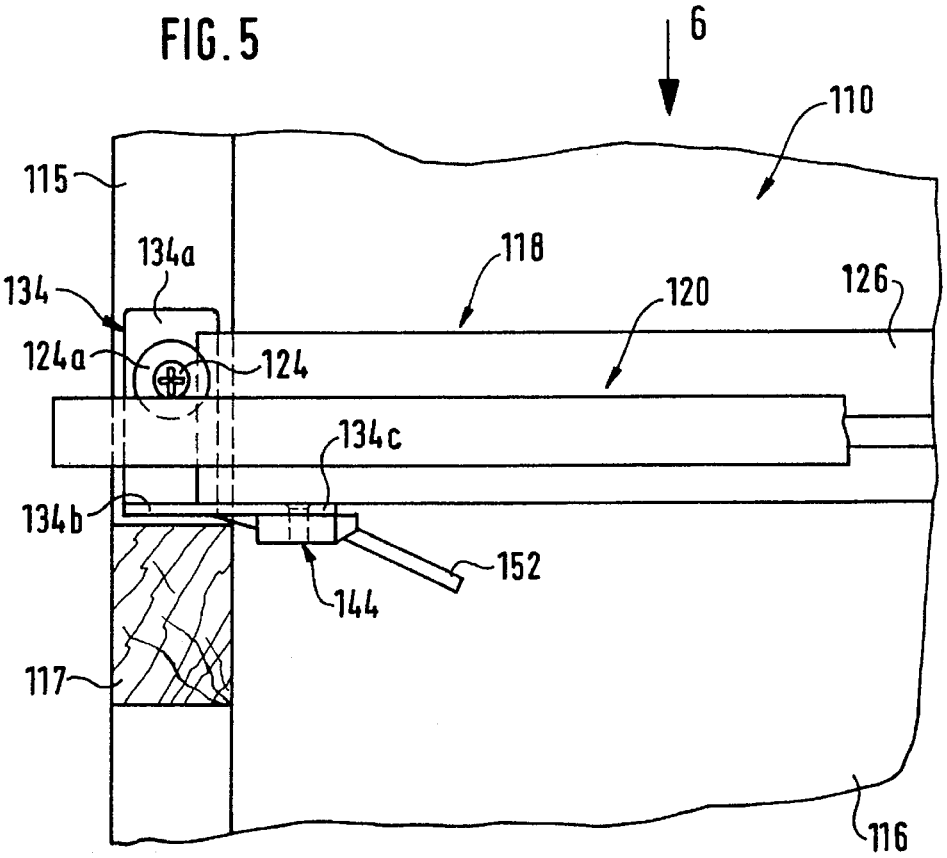
FIG. 5 is a view of a portion of a cabinet as seen in the direction of the inside of its left drawer side, the front end of the slide for a drawer being mounted for vertical adjustment on a frame element projecting from the drawer side.
Figure 6:
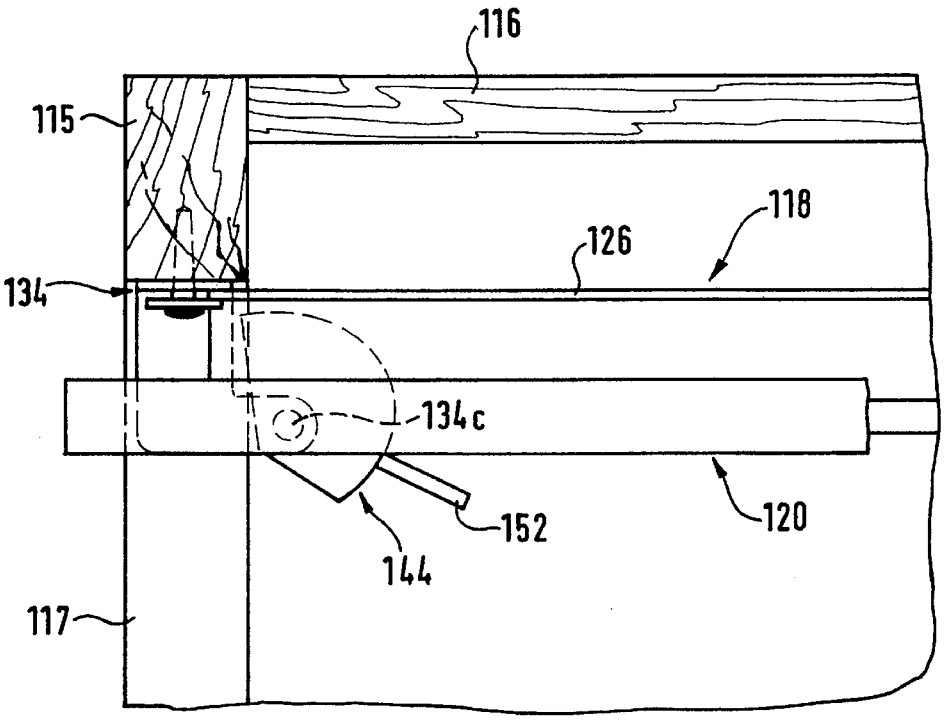
FIG. 6 is an elevational view seen in the direction of arrow 6 in FIG. 5.
Figure 7:
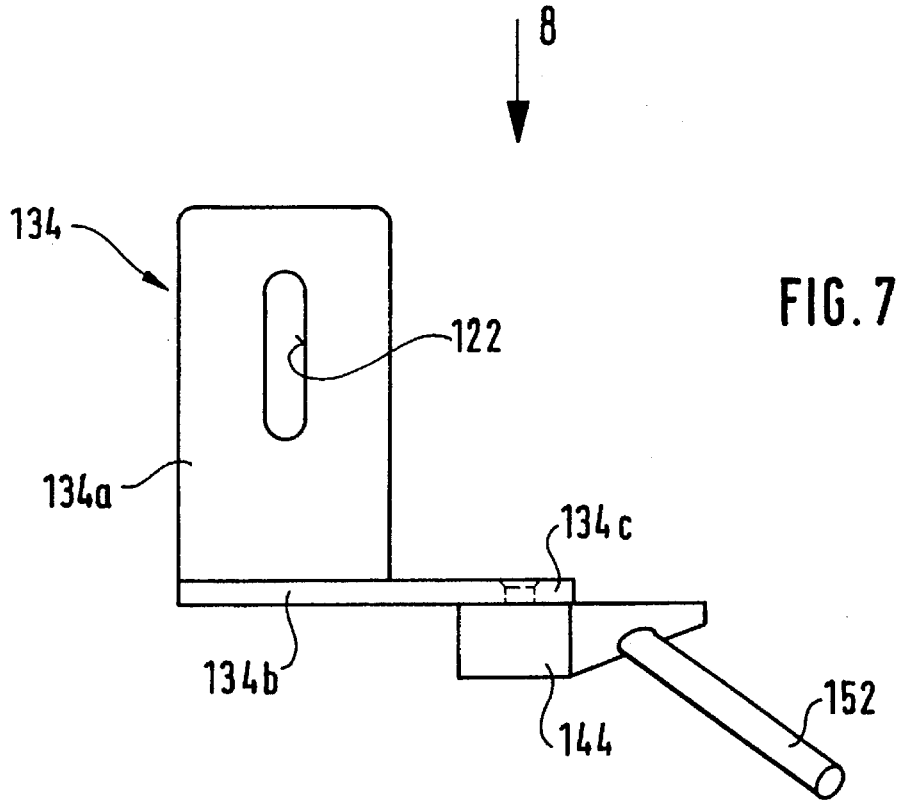
FIG. 7 is a corresponding view as seen in the same direction as in FIG. 5 of the bearing component in the form of a bracket holding up the front end of the guide rail, with the adjuster installed.
Figure 8:
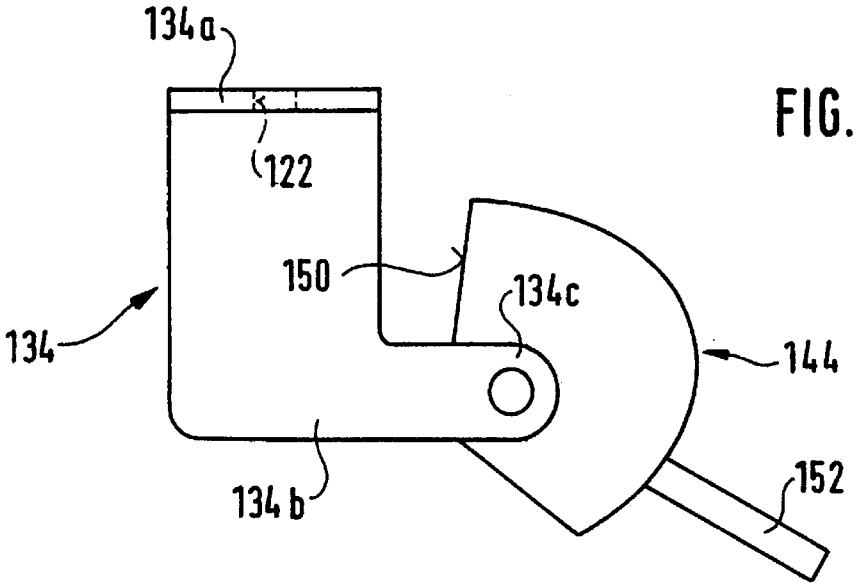
FIG. 8 is a view seen in the direction of arrow 8 in FIG. 7.

In FIGS. 5 and 6 there is shown the configuration and arrangement of a hardware device according to the invention for the vertical adjustment of drawers in a cabinet whose carcase is narrowed at the front end by vertical frame elements 115 projecting from the side walls 116, horizontal frame elements 117 reaching across the entire clear opening being provided between the vertical frame elements 115, at a vertical distance apart corresponding to drawers that are to be arranged one over the other. In the drawings, the front end of a drawer slide 110 is shown schematically, the front ends of the guide rails 118 of which come close to the free face of the vertical frame elements 115 and to the upwardly facing free face of the horizontal frame element 117. The front end of the guide rail 118 is mounted, not directly on the frame elements 115 or 117, but on a separate bearing component configured as a bracket 134. Bracket 134 has one vertical limb 134*a* that is vertically adjustable and can be locked at select vertical positions, and a horizontal limb 134*b* which confronts the upwardly facing surface of the horizontal frame element 117. A tab-like portion 134*c* acting as a bearing component projects toward the carcase interior from the carcase-interior edge of bracket limb 134*b*. On the bottom side of this bearing component 134*c* an adjuster 144 similar to adjuster 44 is mounted for rotation such that the more or less radial edge 150 forming the front end of the area that increases in thickness wedge-like in the direction of rotation lies in the gap formed between the second, horizontal limb 134*b* and the upwardly facing surface of the horizontal frame element 117 forming the steady surface. By swinging the lever arm 152 serving as a handle—counter-clockwise in FIG. 6—the adjuster that is increasingly thick wedge-wise is forced between the bottom of the guide rail 118 and the upwardly facing free surface of frame element 117, and thus lifts it increasingly upward at the front end. Thus also the front end of the corresponding drawer is raised. Locking at the selected level is accomplished by a screw 124 whose shaft is driven through a slot 122 provided in the vertical bracket limb 134*a* into the free surface of frame element 115. A washer 124*a* placed under the head of the screw 124 can then serve simultaneously to lock the front end of profile limb 126 of the guide rail 118 onto the vertical bracket limb 134*a*. In FIGS. 7 and 8, the bracket 134 is represented separately with its limbs 134*a* and 134*b*, and it can be seen that the pivotal mounting of the adjuster 144, which can be provided with the lever arm 152, is done on the bearing component 134*c* projecting inward from the carcase-interior edge of the horizontal bracket limb 134*b*, on the underside thereof.

In the case of the special embodiment of drawer slides described above in connection with the vertical adjustment of drawers, in which the runner rail is supported on the guide rail by rollers held in a cage, it is also possible to arrange the adjuster 144 for rotation directly on the bottom of the lower, horizontal limb of the guide rail 118, and then the separate bearing component formed by the bracket 134 can be omitted. The guide rail is then prolonged at the front end, in comparison to the guide rail 118 used in the embodiment according to FIGS. 5 and 6, to such a degree that on the free face of frame element 115 it reaches to a point close to the front edge. In order to set a selected drawer level, the shaft of a screw 124 is driven into the frame element 115 through a vertical slot that is then provided in the profile limb 126 of the guide rail 118. The separate bearing component in the form of the bracket 134 is then eliminated, but the use of the drawer guide of this configuration with the adjuster provided directly on the guide rail 118 itself is limited to the special application in which the drawer guide cannot be fastened directly on the inside of the carcase side walls, because the frame elements 115 and 117 are provided, which narrow the clear opening of the carcase.

Since the front end of the runner rail, in the second case described and represented in FIGS. 5 and 6 needs to be supported only on the limb 134*b* of the bracket 134, i.e., no fixed attachment is necessary, it is possible on the other hand to apply the described height adjustment even if the drawer guide used for suspending the drawer is of another configuration. Thus, the hardware device described for the vertical adjustment of the outer end of drawers is usable even when, instead of the ball-bearing drawer guide represented in FIGS. 5 and 6, so-called "roller drawer slides" are used, in which the horizontal width is very narrow both on the runner rail and on the guide rail. It is then only to be noted that the runner rails of such a roller drawer guide must be mounted on the drawer side directly above its bottom edge, so that the adjuster of the bearing component can be mounted beneath the downwardly facing edge of the drawer side.

What is claimed is:

1. A hardware device for the vertically adjustable mounting of a drawer mounted by means of drawer slides in a furniture carcase interior, in which the drawer slides have each one guide rail to be fastened in the carcase interior and one runner rail provided on the drawer, said runner rail being provided with roller means, the hardware device comprising a flat adjuster of substantially sector-shaped outline for mounting for rotation about a vertical axis towards an end of a drawer slide adjacent a front end of a furniture carcase, the adjuster being shaped as a wedge increasing in thickness from an approximately radial defining edge in a direction of rotation towards a rear edge of the adjuster, and wherein the adjuster is rotatable about a vertical axis and is insertable between a runner rail of a drawer slide and a bottom face of a drawer bottom to thereby effect a vertical adjustment of the drawer bottom with respect to the runner rail wherein a lever arm acting as a handle extends outwardly from an outer circumference of the adjuster, running radially to the axis of rotation, and the adjuster being oriented such that the substantially radially running edge of the adjuster in an initial position lies directly beside the runner rail, running in a lengthwise direction of the runner rail wherein the adjuster is journaled in a separately formed mounting device attached to the drawer-front end of the runner rail.

2. The hardware device according to claim 1, wherein the adjuster and the lever arm comprise an integral injection molded part made of plastic.

3. The hardware device according to claim 1, wherein the adjuster and the lever arm comprise an integral piece pressure-cast from metal.

4. The hardware device according to claim 1, in which the mounting device has a leaf spring with a latch projection for engaging a recess in the runner rail pushed between the spring and the inside surface of the drawer side, wherein the axis of rotation of the adjuster is provided in the area of the leaf spring of the mounting device such that the radially running edge of the adjuster, when in the initial installed position, lies between the drawer bottom and the area of the spring that is provided with the latch projection.

5. A hardware device for the vertically adjustable mounting of a drawer mounted by means of drawer slides in a furniture carcase interior, in which the drawer slides have each one guide rail fastened in the carcase interior and one runner rail provided on the drawer, said runner rail being provided with roller means, which carcase has on its open front side frame elements projecting at right angles from cabinet side walls and narrowing the cabinet opening, between which side walls horizontal frame elements running parallel and at a distance apart are disposed, which define rectangularly defined passage openings in the front of the carcase, through each of which a drawer body can be introduced into the carcase interior, the guide rails of the drawer slides being in each case disposed at a distance from the adjacent carcase side wall and mounted at their front end on one of the frame elements the hardware device comprising a flat adjuster of substantially sector-shaped outline for mounting for rotation about a vertical axis towards an end of a drawer slide adjacent a front end of a furniture carcase, the adjuster being shaped as a wedge increasing in thickness from an approximately radial defining edge in a direction of rotation towards a rear edge of the adjuster, and wherein the adjuster is rotatable about a vertical axis and is insertable between a runner rail of a drawer slide and a support surface disposed opposite the runner rail in a vertically invariable manner, wherein a lever arm acting as handle extends outwardly from an outer circumference of the adjuster, running radially to the axis of rotation, wherein the adjuster is mounted in a separate bearing component which is fastenable to an inwardly facing surface of one of the frame elements.

6. The hardware device according to claim 5, wherein the bearing component has the shape of an angle bracket having a vertical limb mountable on a free edge of the vertical frame element projecting from an adjacent cabinet side wall so as to be displaceable and fastened at selected heights, while a horizontal limb of the angle bracket is mountable by way of an upper side thereof on the front end of the guide rail, and wherein the adjuster is mounted on an underside of the horizontal limb such that the defining edge, in the initial installed position, is at a level of a gap formed between the horizontal limb and an upwardly facing surface that acts as the support surface of the horizontally disposed frame element.

7. The hardware device according to claim 6, wherein the adjuster is provided on an underside of a bearing projection projecting into the carcase interior from the horizontal limb when in the installed position.

8. The hardware device according to claim 6, wherein in the vertical bracket limb a slot running vertically is provided, through which the shaft of a screw is drivable into the vertical frame element.

* * * * *